US010406647B2

(12) United States Patent
Tatomir

(10) Patent No.: US 10,406,647 B2
(45) Date of Patent: Sep. 10, 2019

(54) SHARPENING SYSTEM FOR ICE SKATE RUNNERS

(71) Applicant: Wally Wayne Tatomir, Raleigh, NC (US)

(72) Inventor: Wally Wayne Tatomir, Raleigh, NC (US)

( * ) Notice: Subject to any disclaimer, the term of this patent is extended or adjusted under 35 U.S.C. 154(b) by 0 days.

(21) Appl. No.: 15/585,242

(22) Filed: May 3, 2017

(65) Prior Publication Data

US 2017/0320184 A1 Nov. 9, 2017

Related U.S. Application Data

(60) Provisional application No. 62/333,345, filed on May 9, 2016.

(51) Int. Cl.
*B24B 3/00* (2006.01)
*B24B 17/02* (2006.01)

(52) U.S. Cl.
CPC ..... *B24B 3/003* (2013.01); *B24B 17/02* (2013.01)

(58) Field of Classification Search
CPC ..... B24B 3/003; B24B 3/00; B24B 17/02
USPC ..... 451/237, 45, 383; 76/83
See application file for complete search history.

(56) References Cited

U.S. PATENT DOCUMENTS 1,487,142 A * 3/1924 Boker ..... B24B 3/003 451/213
3,789,551 A * 2/1974 Norris ..... B24B 3/003 451/237
4,109,419 A * 8/1978 Broadbent ..... B24B 3/003 451/216
4,172,343 A * 10/1979 Sakcriska ..... B24B 3/003 451/237

* cited by examiner

*Primary Examiner* — Robert A Rose
(74) *Attorney, Agent, or Firm* — Coats & Bennett, PLLC

(57) ABSTRACT

A skate sharpening system comprises an adjustor assembly and a skate holder assembly. A runner is releasably coupled to a template runner, and then clamped into the skate holder assembly. The template runner defines a pre-defined profile for the blank runner. An operator moves the skate holder assembly such that the template runner moves along a guide bearing of the adjustor assembly. The guide bearing is disposed proximate a grinding wheel. While the template runner remains in contact with the adjustable guide bearing, the runner remains in contact with, and moves along, the grinding wheel such that the grinding wheel simultaneously sharpens and contours the runner.

16 Claims, 13 Drawing Sheets

SHARPENING SYSTEM FOR ICE SKATE RUNNERS

RELATED APPLICATIONS

This application claims priority to U.S. Provisional Patent Application Ser. No. 62/333,345 filed May 9, 2016, the entire contents of which are incorporated herein by reference.

FIELD OF THE INVENTION

The present disclosure relates systems and devices for sharpening the runners of ice skates.

BACKGROUND

People enjoy ice skating for many different reasons. Some people enjoy recreational skating, while others like to figure skate or play the sport of ice hockey. Regardless of the reason for skating, however, all ice skates have a blade or "runner" functioning as the sole interface between the skater and the ice surface. Additionally, all runners are "profiled" or "contoured," as well as sharpened. The profiling process alters the shape of a runner and defines how much of the runner is in contact with the ice. The sharpening process creates a concave "hollow" along the bottom surface of the runner by grinding metal off the runner. Creating the hollow sharpens the inside and outside edges of the runner.

Conventional systems are only able to sharpen the middle portion of a runner. They are not configured to profile and sharpen substantially the entire length of the runner at the same time.

SUMMARY

The present disclosure provides a method and corresponding system for simultaneously shaping and sharpening a runner for an ice skate. In one embodiment, a template runner is releasably coupled in a spaced-apart relationship to the runner for the ice skate. The template runner defines a selected profile or contour for the runner, and is guided along an adjustable guide bearing disposed a proximate a grinding wheel. While the template runner remains in contact with the adjustable guide bearing, the runner simultaneously remains in contact with the grinding wheel. Thus, guiding the template runner along the guide bearing causes the grinding wheel to simultaneously contour the runner according to the profile of the template runner and sharpen the runner.

In one embodiment, the system comprises a holder assembly, an adjustable guide assembly, and a skate sharpening machine that houses a grinding wheel. A runner to be contoured and sharpened is releasably coupled to a template runner in a spaced-apart relationship and secured by the holder assembly. The template runner defines a selected profile for the runner to be contoured and sharpened. The adjustable guide assembly comprises an adjustable guide bearing that is disposed proximate the grinding wheel. The adjustable guide bearing is configured to guide the template runner as an operator moves the holder assembly. While the template runner is in contact with the adjustable guide bearing, the runner to be contoured and sharpened is in contact with the grinding wheel, such that the grinding wheel simultaneously sharpens the runner, while contouring the runner in accordance with the profile of the template runner.

One embodiment of the present disclosure provides a sharpening machine for skate blades, such as those used for ice skates. In this embodiment, the sharpening machine comprises a grinder housing and an adjustable guide assembly attached to the grinder housing. The grinder housing comprises a grinding wheel configured to sharpen a skate blade releasably clamped in spaced-relation to a template that defines a predetermined profile for the skate blade. The adjustable guide assembly is attached to the grinder housing and comprises a vertically adjustable guide bearing and an adjustable guide block. The vertically adjustable guide bearing is configured to engage and ride along the template while the skate blade is being sharpened. The adjustable guide block is configured to move the guide bearing horizontally relative to the grinding wheel.

In one embodiment, the present disclosure provides a sharpening system for ice skate blades. In this embodiment, the system comprises a clamp assembly, an adjustable guide bearing, and a grinding wheel. The clamp assembly is configured to releasably clamp a skate blade to be profiled and sharpened in spaced-relation to a template. The template defines a predetermined profile to be transferred to the skate blade. The adjustable guide bearing is configured to engage and ride along the template while the skate blade is being sharpened. The grinding wheel is configured to simultaneously sharpen and profile the skate blade in accordance with the predetermined profile of the template.

Of course, those skilled in the art will appreciate that the present disclosure is not limited to the above contexts or examples, and will recognize additional features and advantages upon reading the following detailed description and upon viewing the accompanying drawings.

DETAILED DESCRIPTION

Figure 1A:
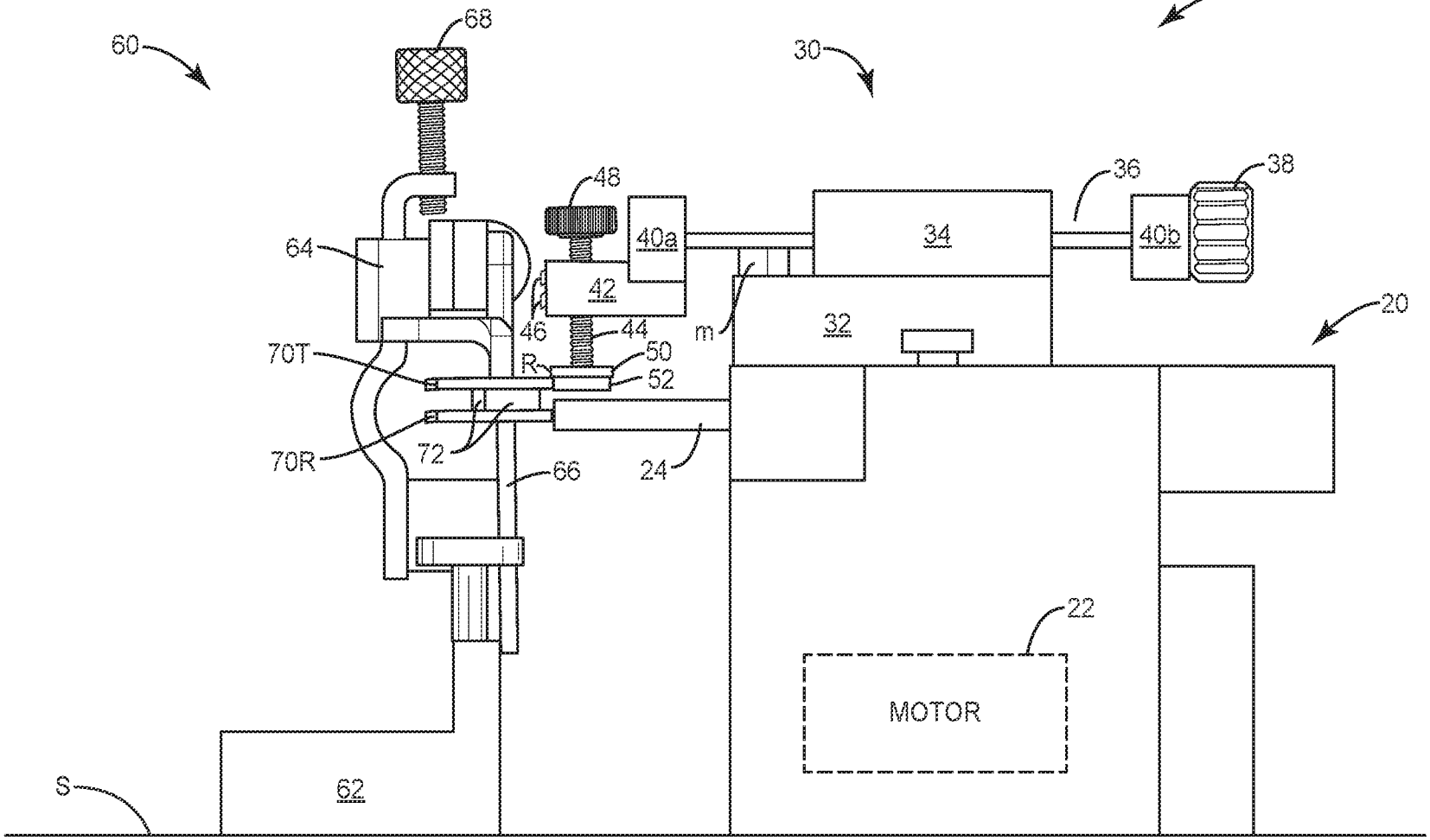
FIGS. 1A-1B are perspective views of a sharpening system according to one embodiment of the present disclosure.
Figure 1B:
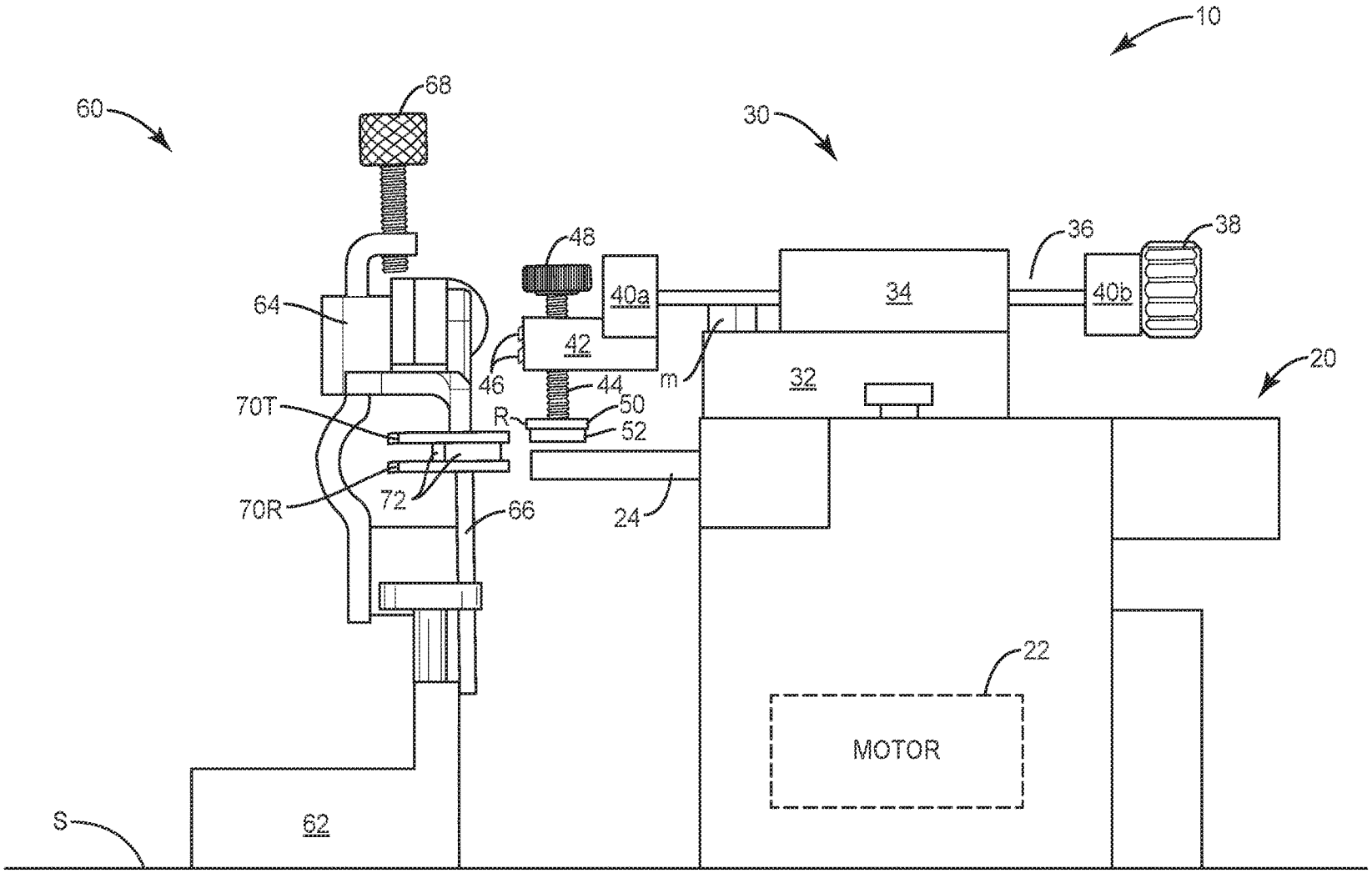

FIGS. 1A-1B are perspective views of an ice skate sharpening system 10 configured according to one embodiment of the present disclosure. As seen in FIG. 1, system 10 comprises a grinder housing or "box" 20, an adjustable guide assembly 30, and a skate holder assembly 60. The box 20 is usually secured to a stable underlying surface S, and houses, inter alia, a motor 22 and a grinding wheel 24 that is oriented substantially horizontally relative to the underlying surface S. Box 20 is typically connected to a power source (not shown), such as an outlet, for example, that provides the motor 22 with the power needed to drive the grinding wheel 24 at a desired revolutions per minute (RPM) that is sufficient with which to sharpen the bottom of a runner.

Those of ordinary skill in the art will appreciate that neither the particular motor 22 that is used, nor the particular grinding wheel 24 that is used, is germane to the present disclosure. Indeed, there are many different types and manufacturers for such boxes 20, and each may have their own components. However, in one embodiment, the motor 22 comprises a ¾ horsepower (HP) motor that drives the grinding wheel 24 at 3600 RPMs. At this speed, the grinding wheel 24 rotates fast enough to remove thin layers of metal from the runner along the bottom length of the runner. As is conventional, the grinding wheel 24 may be of different diameters, and is releasably attached to box 20 such an operator can replace a worn grinding wheel 24 with a new or different sized grinding wheel 24.

The adjustable guide assembly 30 fixedly attaches to the top surface of box 20, and comprises a guide riser block 32, an adjustable guide block 34, an adjuster block 42, and an adjustable fine threaded bearing guide shaft 44. The guide riser block 32 comprises a solid, unitary piece of lightweight metal or metal alloy, and securely mounts to the top surface of box 20 using, for example, a plurality of mechanical fasteners such as screws or bolts. Once mounted, the guide riser block 32 forms a secure foundation on which to mount the adjustable guide block 34.

As will be seen in more detail in a later figure, the guide riser block 32 comprises a cutout formed on a top surface. The cutout allows the adjustable guide block 34 to move back and forth relative to the riser block 32 so that the operator can move the adjustable guide shaft 44 relative to the grinding wheel 24. This is beneficial because grinding wheels 24 often wear from repeated sharpenings, which decreases the diameter of the grinding wheels 24. The cutout desirably allows the operator to maintain the position of the adjustable guide shaft 44 above the peripheral edge of the grinding wheel 24. Further, this allows the grinding wheel 24 to be used longer, and thus, the operator need not change the grinding wheel 24 as often as is needed in a conventional sharpening system.

The adjustable guide block 34 comprises one or more adjustor rods 36, an adjustor control knob 38, and a pair of terminal end blocks 40*a*, 40*b* (collectively 40). The adjustable guide block 34 permits an operator of system 10 to move the adjuster block 42 and guide bearing 50 horizontally relative to the riser block 32.

Figure 4A:
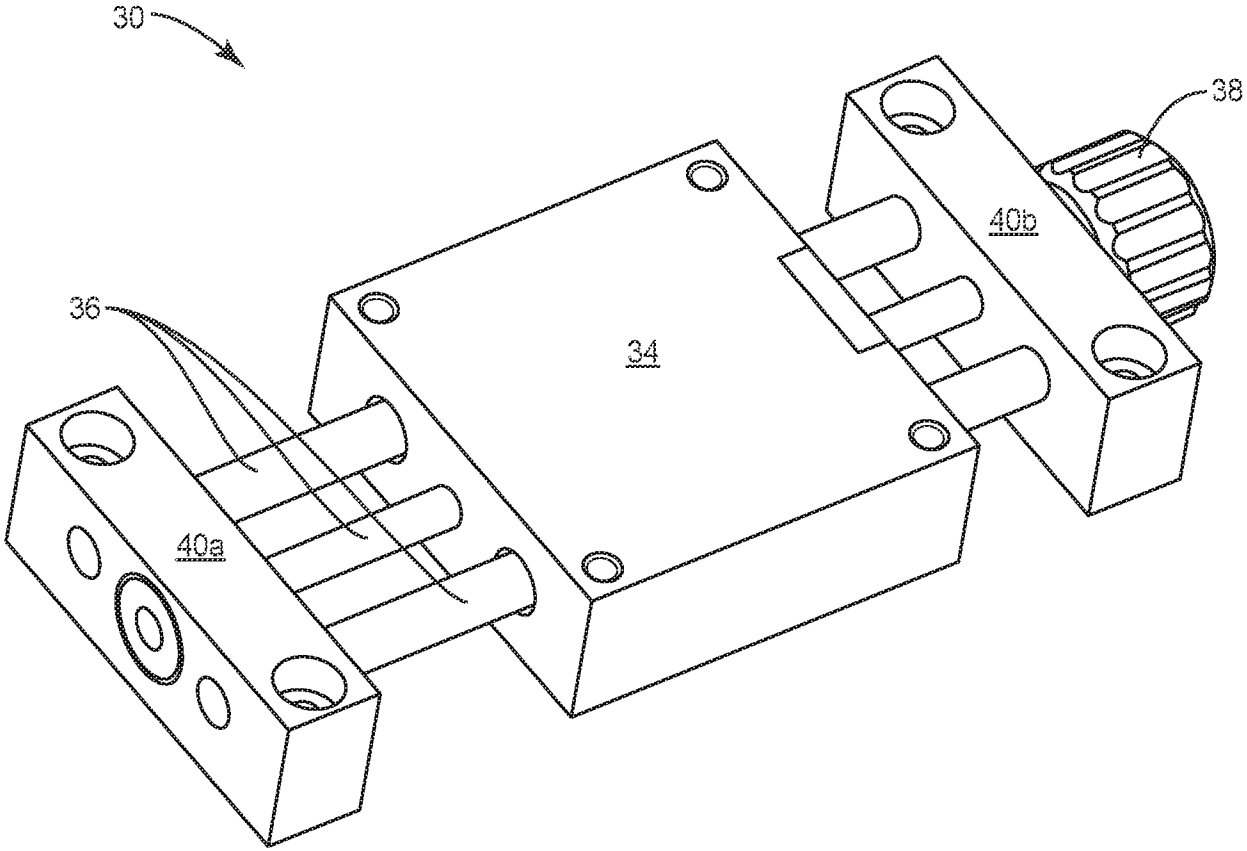
FIGS. 4A-4D are perspective views of some exemplary component parts of an adjustable guide assembly configured according to one embodiment of the present disclosure.

In this embodiment, a plurality of adjustor rods 36, such as those seen in FIG. 4A, extend into and out of the adjustable guide block 34 at generally equidistant positions, although such positioning is not required. One of the adjustor rods 36 connects the adjustor control knob 38 to the terminal end block 40*a*, while the other adjustor rods 36 terminate at, and connect, the terminal end blocks 40*a*, 40*b*. Turning the adjustor control knob 38 in one direction causes the terminal end block 40*a* to move towards the adjustable guide block 34, while turning the adjustor control knob 38 in the opposite direction will cause the terminal end block 40*a* to move away from adjustable guide block 34. In this manner, the operator of system 10 is able to adjust the position of the guide bearing 50 relative to the riser block 32, while maintaining a uniform distance between the bottom surface of the guide bearing 50 and the surface of the grinding wheel 24.

The adjuster block 42 securely fastens to a bottom surface of the terminal end block 40*a* using, for example, screws or bolts, and comprises a threaded channel (seen later in FIG. 4C) configured to threadingly receive adjustable guide shaft 44. A pair of adjustable set screws 46 extends into the threaded channel and allows the operator to lock and unlock the adjustable guide shaft 44 within the adjustment block 42. Particularly, the adjustable set screws 46 (e.g., set screws) are configured to be tightened and loosened by the operator. When tightened, the adjustable set screws 46 pressingly engage the adjustable guide shaft 44 to ensure that it does not move within the threaded channel of adjustment block 42 once positioned by the operator. This is the locked position. When loosened (i.e., unlocked), the adjustable set screws 46 move away from adjustable guide shaft 44 thereby allowing adjustable guide shaft 44 to move within the threaded channel.

The adjustable guide shaft 44 allows the operator to adjust the guide bearing 50 vertically relative to the top surface of the grinding wheel 24. Particularly, turning the control knob 48 in one direction causes the guide bearing 50 to move towards the grinding wheel 24, while turning the control knob 38 in the opposite direction causes the guide bearing 50 to move away from the grinding wheel 24. The distance between the bottom surface of the guide bearing 50 and the top surface of the grinding wheel 24 can vary based on the separation distance between the runners 70R, 70T, the thickness of the runners, and other factors, and may be any distance desired. For example, that distance may be in the range of 1 mm-7 mm However, in one embodiment, that distance is approximately 2.5 mm.

The guide bearing 50 comprises a recess 52. A ridge R is disposed at one end of recess 52. As seen in FIG. 1B, a template runner 70T contacts recess 52 and a bottom surface of the ridge R when profiling and sharpening the runner 70R. The guide bearing 50 also rotates freely about the adjustable guide shaft 44 as the template runner 70T moves horizontally back and forth while profiling and sharpening runner 70R. The recess 52 and the ridge R prevent the template runner 70T from riding up the guide bearing 50 during the profiling and sharpening operations.

Figure 1C:
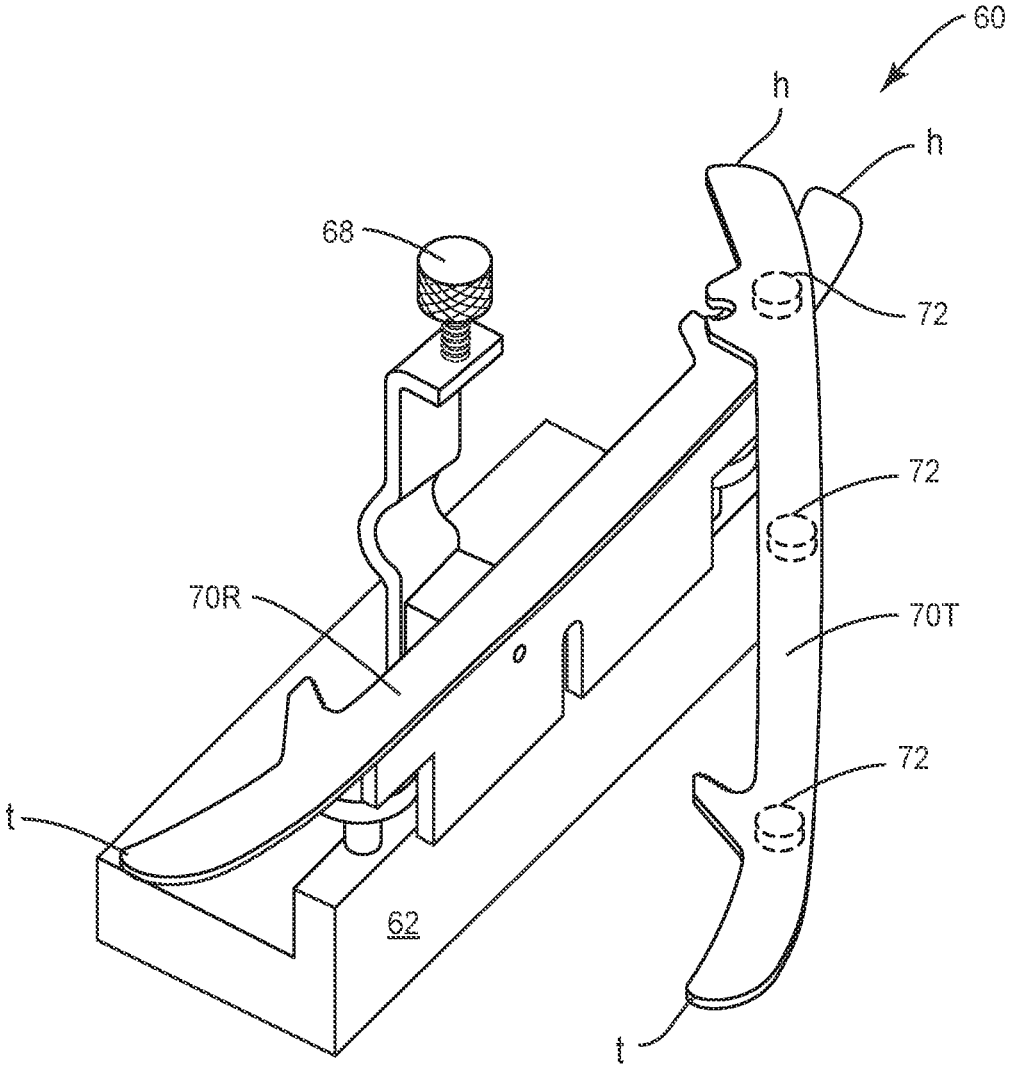
FIG. 1C is a perspective view of a skate holder assembly configured to receive a template runner and a blank runner according to one embodiment of the present disclosure.

The skate holder assembly 60, best seen in FIG. 10, comprises a base 62, an upper clamp portion 64, a lower clamp portion 66, and a control knob 68. As seen in FIGS. 1A-1C, the base 62 comprises a unitary block that moves along the underlying surface S as the operator profiles and sharpens the runner 70R. The template runner 70T and the runner 70R are clamped securely between the upper and lower clamp portions 64, 66. One or more couplers 72 are disposed between the template runner 70T and runner 70R, and function to maintain a uniform separation distance between the two runners 70R, 70T.

In this embodiment, the couplers 72 comprise a plurality of magnets. The magnets are disposed at a generally uniform spacing along the template runner 70T and maintain a uniform distance between the template runner 70T and runner 70R. Additionally, in this embodiment, the couplers 72 releasably attach to both the template runner 70T and the runner 70R. This allows the operator to move and position the couplers 70T in any manner desired. However, those of ordinary skill in the art will appreciate that the present disclosure is not so limited. In other embodiments, the couplers 72 are securely affixed to the template runner 70T. In such embodiments, the template runner 70T and the couplers 72 are magnetic and formed as a unitary piece with the runner 70R being releasably attached to the couplers.

As seen in FIG. 1A-1C, the operator first couples the template runner 70T and the runner 70R using couplers 72. The coupled runners 70T, 70R are then placed between the upper and lower clamp portions 64, 66. The operator then rotates the control knob 68 to tighten the coupled runners 70T, 70R tightly between the upper and lower clamp portions 64, 66. Once the runners 70T, 70R are securely clamped, the operator can bring the template runner 70T into contact with the recess 52 on guide bearing 50, as seen in FIG. 1B. This also brings the runner 70R to be profiled and sharpened into contact with the grinding wheel 24. The operator can then move the skate holder assembly 60 along surface S such that the grinding wheel 24 sharpens the runner 70R.

Conventionally, as stated above, the profiling process and the sharpening process are performed separately. However, such conventional methods require multiple machines (i.e., one machine to profile a runner and another to sharpen the runner after profiling), and thus, also require more time. Additionally, conventional methods are not able to profile and sharpen the entire length of the runner from the toe t of the runner to the heel h of the runner. Rather, they only serve to profile and sharpen a lesser, middle portion of a runner. Further, conventional methods are notoriously prone to operator error. Particularly, the operator may not profile the runner properly. And even if the operator does profile the runner properly, there is a risk that the operator may undesirably, and unknowingly, alter the profile of the runner while performing the separate sharpening process.

Embodiments of the present disclosure, however, reduce these risks by providing the capability for the operator to profile a runner, as well as sharpen the runner, at the same time. Moreover, embodiments of the present disclosure also allow the operator to profile and sharpen substantially the entire length of the runner (i.e., from the toe t to the heel h) instead of just a middle portion, as is done in conventional methods.

In particular, the template runner 70T is pre-formed by a manufacturer to have a predetermined profile. Such profiles, as is known in the art, may define one or more radii for a runner. Some profiles, for example, may pitch a skater forward, while other profiles help to maintain the skater in a more neutral position. The grinding wheel 24, as stated above, sharpens the runner. Thus, by attaching the template runner 70T to a "blank" runner 70R (i.e., an unprofiled and unsharpened runner), and by moving the template runner 70T along the recess 52 of guide bearing 50, as is done in the present embodiments, the blank runner 70R will be profiled to have the same contour as the template runner 70T at the same time it is being sharpened by grinding wheel 24. Further, since both the template runner 70T and the blank runner 70R are clamped to the skate holder assembly 60, and because of the stability provided by recess 52 and guide bearing 50, the operator is able to move the skate holder assembly 60 along the underlying surface S such that the substantially the entire length of the blank runner 70R (i.e., from the toe of the runner to the heel of the runner) is profiled and sharpened.

Figure 1D:
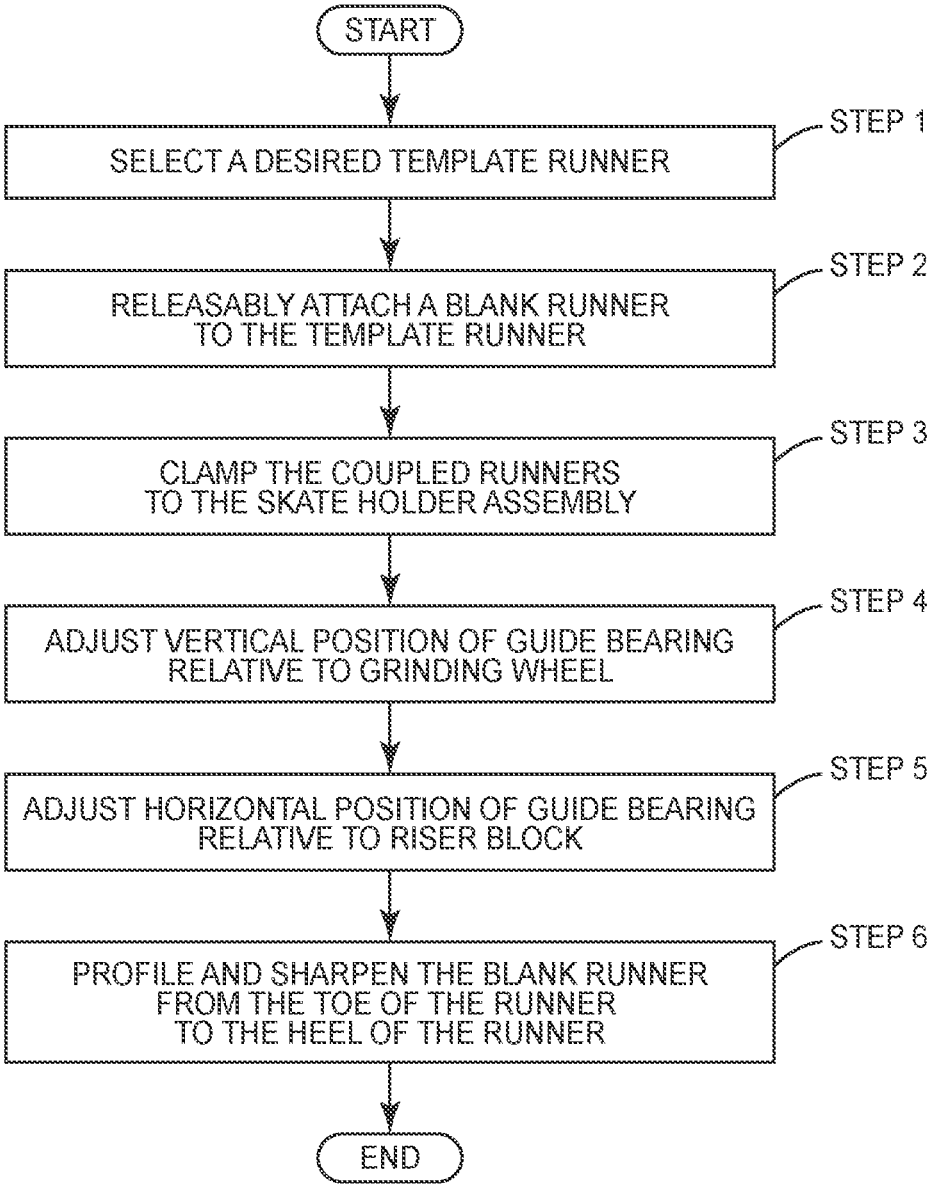
FIG. 1D is a flow diagram illustrating a method of sharpening a blank runner according to one embodiment of the present disclosure.

FIG. 1D illustrates a method for profiling and sharpening a blank runner 70R according to one embodiment of the present disclosure. As seen in FIG. 1D, the method comprises:

Step 1: The operator first selects a desired template runner 70T from among a plurality of template runners 70T. As previously stated, each template runner 70T has a unique profile or contour that may be defined by the manufacturer of the template runner 70T.

Step 2: The operator then releasably attaches the blank runner 70R to the template runner 70T using the couplers 72. As previously described, the couplers 72 may comprise one or more magnets that are evenly spaced along the template runner 70T. Additionally, the couplers 72 help to maintain a uniform distance between the two runners 70T, 70R. The particular distance may be any distance needed or desired; however, the distance is such that the template runner 70T contacts the recess 52 on guide bearing 50, and the blank runner 70R contacts the edge of grinding wheel 24. This distance may be in the range of 1 mm-7 mm, for example, and in one embodiment, that distance is about 4 mm.

Step 3: The operator then clamps the coupled runners 70T, 70R between the upper and lower clamp portions 64, 66 of the skate holder assembly 60.

Step 4: Using control knob 48, the user adjusts the vertical position of the guide bearing 50 relative to the grinding wheel 24. As stated above, the vertical distance between the guide bearing 50 and the grinding wheel 24 is 2.5 mm in one embodiment. Once the guide bearing is in the desired position, the operator locks the bearing guide shaft 44 into that position using adjustment screws 46.

Step 5: Using the control knob 38 on the adjustable guide assembly 30, the operator then adjusts the horizontal position of the guide bearing 50 relative to the riser block 32. The horizontal position of the guide bearing 50 is such that the template runner 70T contacts the recess 52 of guide bearing 50 at the same time the blank runner 70R contacts the grinding wheel 24.

Step 6: The operator may then begin to profile and sharpen the blank runner 70R from the toe t to the heel h, as previously described. Specifically, in one embodiment, the operator moves the skate holder assembly 60 towards the box 20 such that the toe t of the template runner 70T contacts the recess 52 of guide bearing 50. The bottom surface of the ridge R on guide bearing 50 also contacts the top surface of the template runner 70T. This helps to stabilize the template runner 70T during the profiling and sharpening process. The operator then slides the skate holder assembly 60 along the underlying surface S such that entire length of template runner 70T moves along recess 52 (i.e., from the toe to the heel of the template runner 70T) while maintaining contact with recess 52. That is, the recess 52 engages and rides along the template runner 70T. As the operator performs this motion, the blank runner 70R simultaneously contacts the grinding wheel 24, thereby forming the hollow and edges on the blank runner 70R along the length of the runner 70R from the toe t to the heel h of runner 70R.

As those skilled in the art will appreciate, the operator may also slide the skate holder assembly 60 along the underlying surface S such that entire length of template runner 70T moves along recess 52 from the heel to the toe of the template runner 70T. Typically, the operator will slide the skate holder assembly 60 in the same direction as the rotation of the grinding wheel 24. This helps to avoid any uneven surfaces on runner 70R that may be caused by the grinding wheel 24. Regardless of the direction in which the template runner 70T is moved, however (i.e., toe to heel or heel to toe), the template runner 70T maintains contact with recess 52, which also ensures an even sharpened and profiled surface on runner 70R.

Figure 2A:
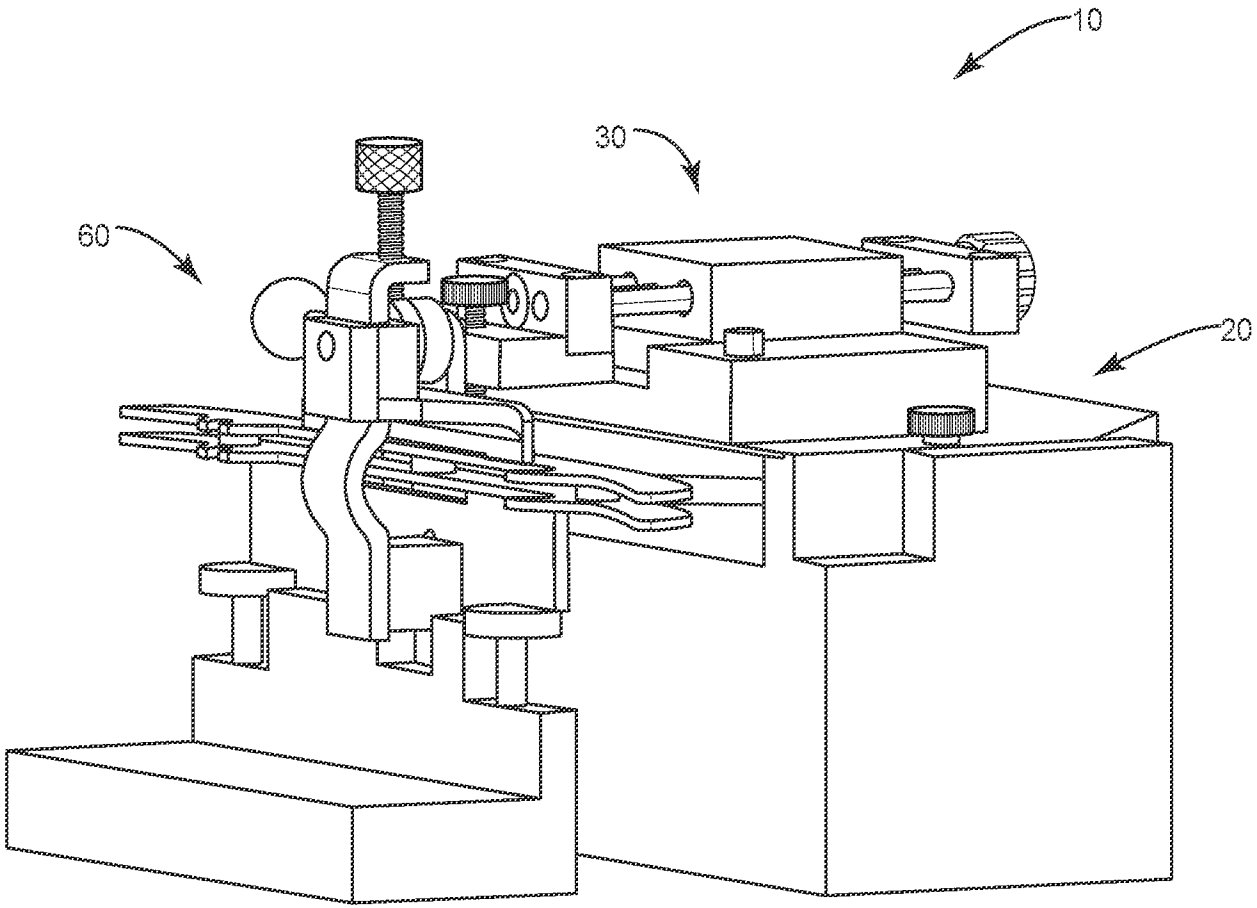
FIGS. 2A-2C are perspective views of the sharpening system of the present disclosure from various viewing angles.
Figure 2B:
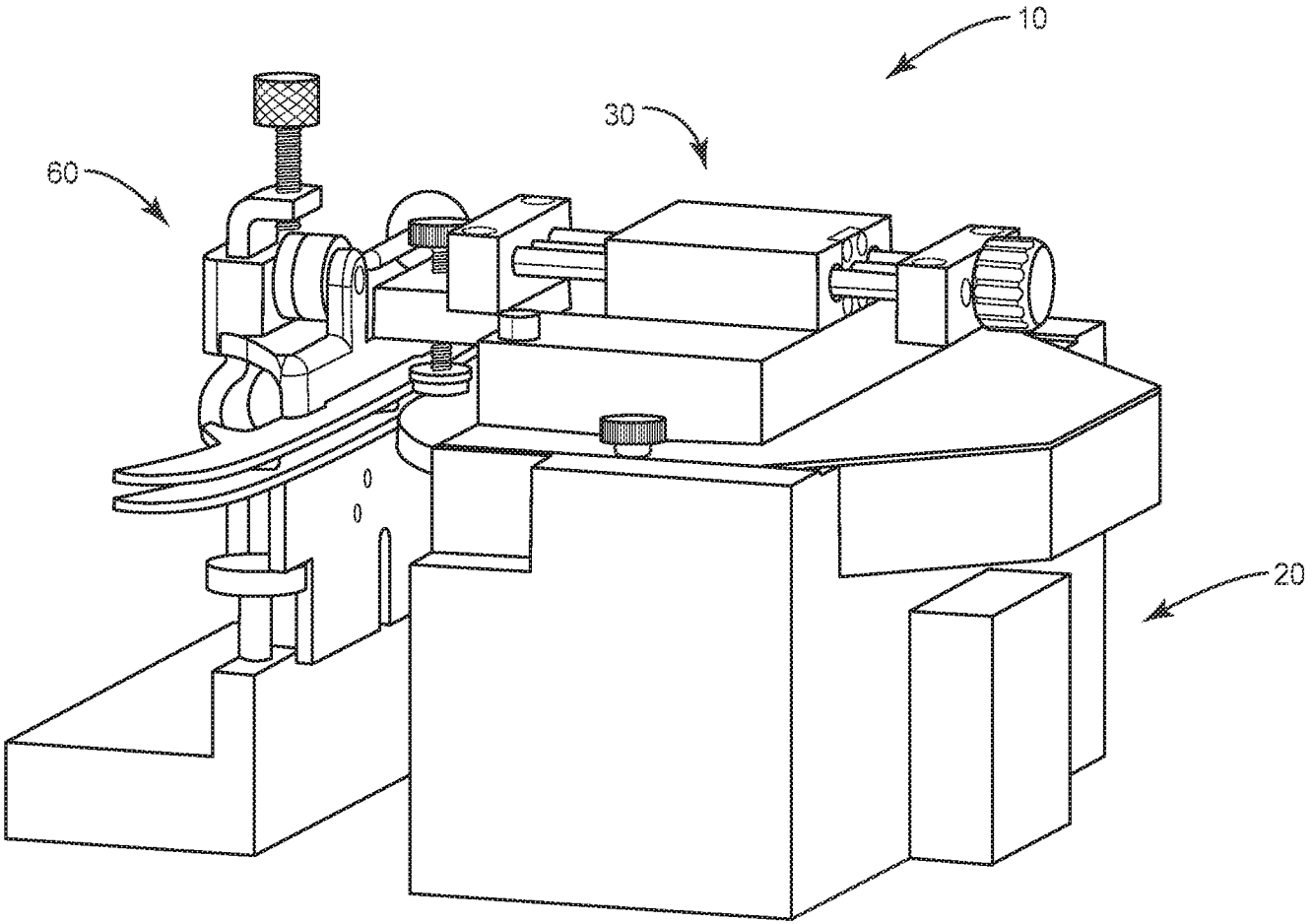
Figure 2C:
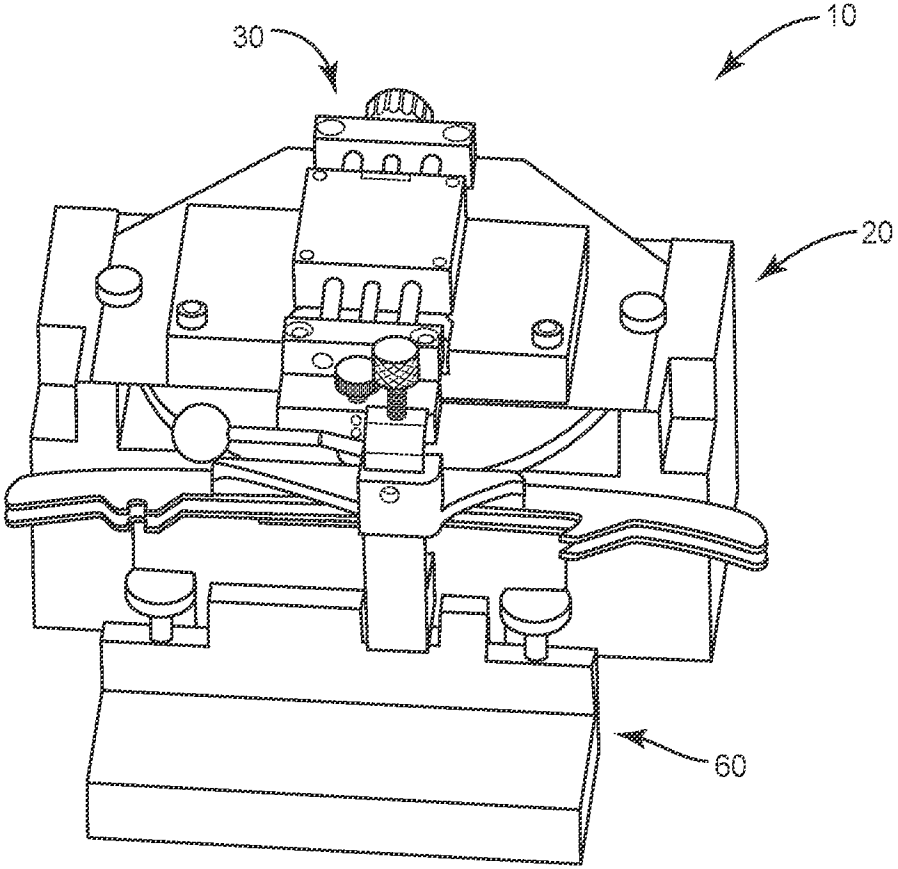

FIGS. 2A-2C are perspective views of the system 10 configured according to one embodiment of the present disclosure. Specifically, FIG. 2A illustrates system 10 from the front and side. FIG. 2B illustrates system 10 from the rear and side. FIG. 2C is a perspective view of system 10 as seen from the front and above.

Figure 3A:
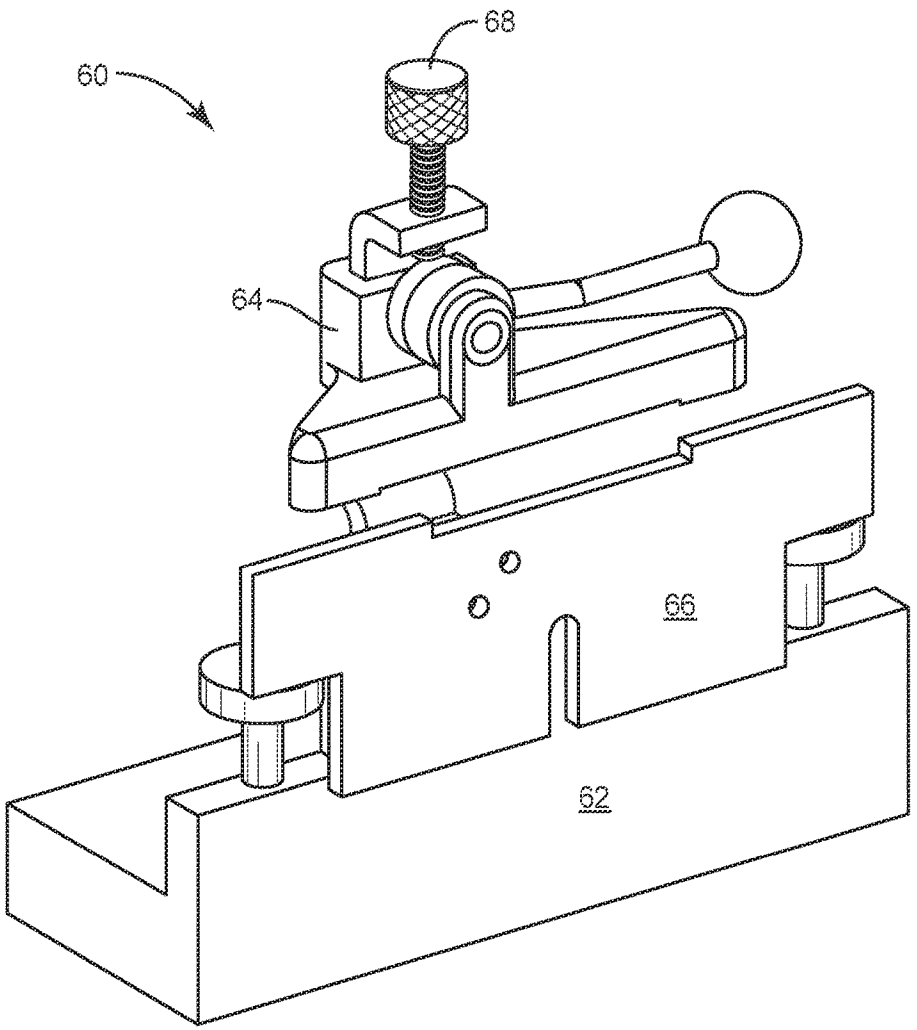
FIGS. 3A-3B are perspective views of a skate holder assembly configured according to one embodiment of the present disclosure.
Figure 3B:
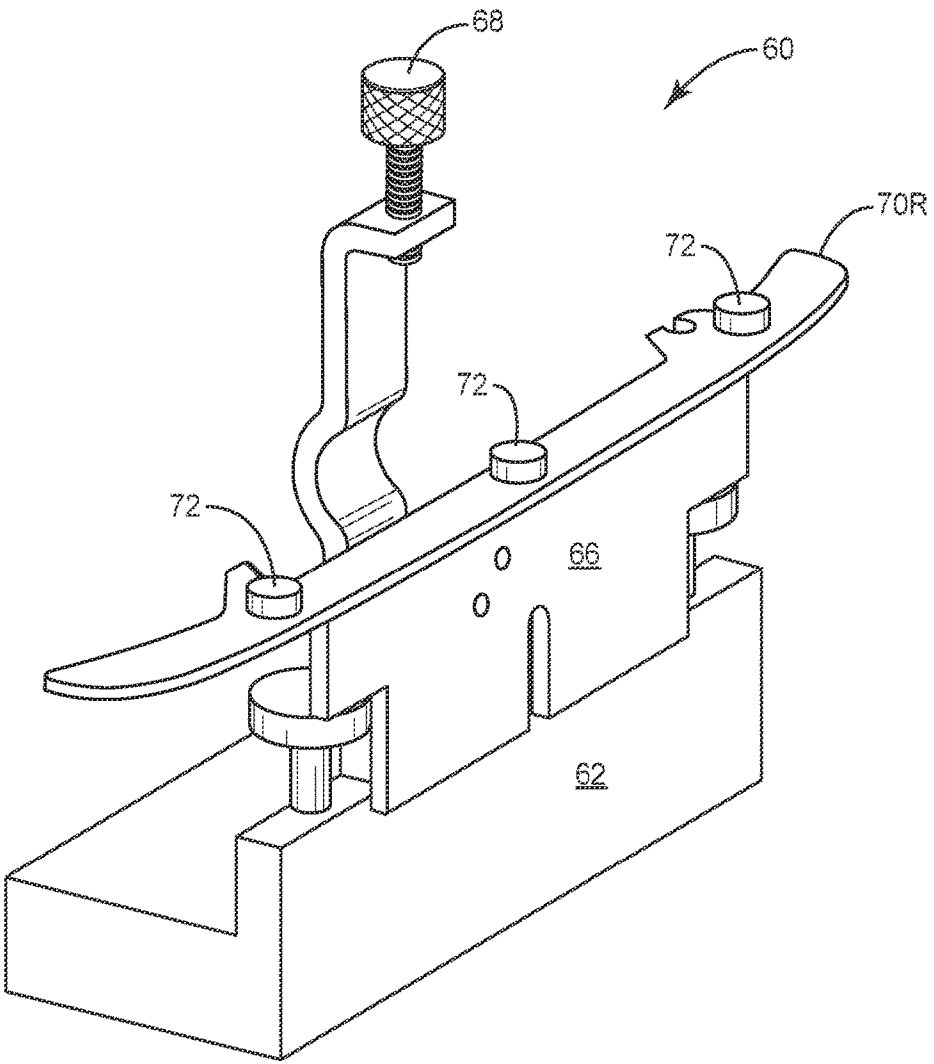

FIGS. 3A-3B are perspective views of the skate holder assembly 60 configured according to one embodiment of the present disclosure. FIG. 3A illustrates the skate holder assembly 60 without the template runner 70T and blank runner 70R clamped thereto. FIG. 3B illustrates the skate holder assembly 60 with the upper clamp portion 64 removed to show the blank runner 70R and the couplers 72 that releasably attach the blank runner 70R to the template runner 70T.

FIGS. 4A-4D are perspective views illustrating the component parts of the adjustable guide assembly 30. Specifically, FIG. 4A illustrates the adjustable guide block 34 including the one or more adjustor rods 36 that extend through the adjustable guide block 34, the pair of terminal end blocks 40, and the adjustor control knob 38 that moves the terminal end block 40*a*, via the one or more rods 36, back and forth horizontally relative to the adjustable guide block 34.

Figure 4B:
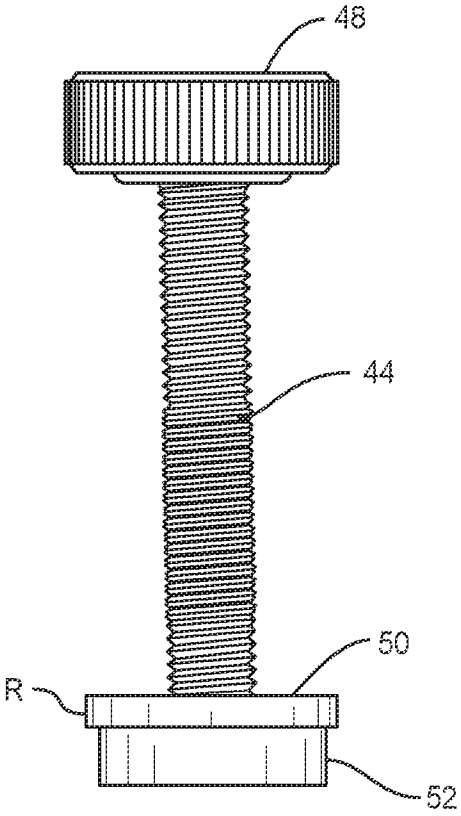

FIG. 4B is a perspective view illustrating the adjustable guide shaft 44 in more detail. As seen in FIG. 4B, the adjustable guide shaft comprises a fine threaded shaft. The guide bearing 50 is fixedly secured to a terminal end of the guide shaft 44, but still rotates freely about guide shaft 44 with the movement of template runner 70T. This may be accomplished, for example, by configuring the guide bearing 50 to ride on a plurality of lubricated bearings disposed between the guide shaft 44 and the interior of the guide bearing 50. The recess 52 and the ridge R formed on the guide bearing 50 are also seen in FIG. 4B, as is the control knob 38 that is utilized by the operator to alter the horizontal position of the guide bearing 50 relative to the top surface of the grinding wheel 24, as previously described.

Figure 4C:
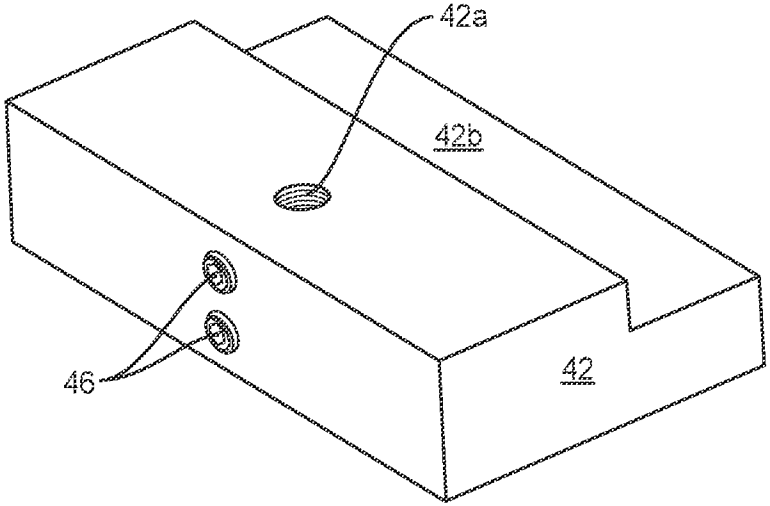

FIG. 4C is a perspective view of the adjuster block 42 configured according to one embodiment. As seen in FIG. 4C, the adjustor block 42 comprises the threaded channel 42*a* through which the guide shaft 44 extends, as previously described, as well as a recessed area 42*b*. The recessed area 42*b* is sized and shaped to receive the terminal end block 40*a* to which the adjuster block 42 is fixedly attached using mechanical fasteners, for example. Additionally, FIG. 4C also illustrates the adjustable set screws 46 that are utilized by the operator to lock and unlock the adjustable guide shaft 44, and thus, the guide bearing 50, in a desirable horizontal position relative to the grinding wheel 24, as previously stated.

Figure 4D:
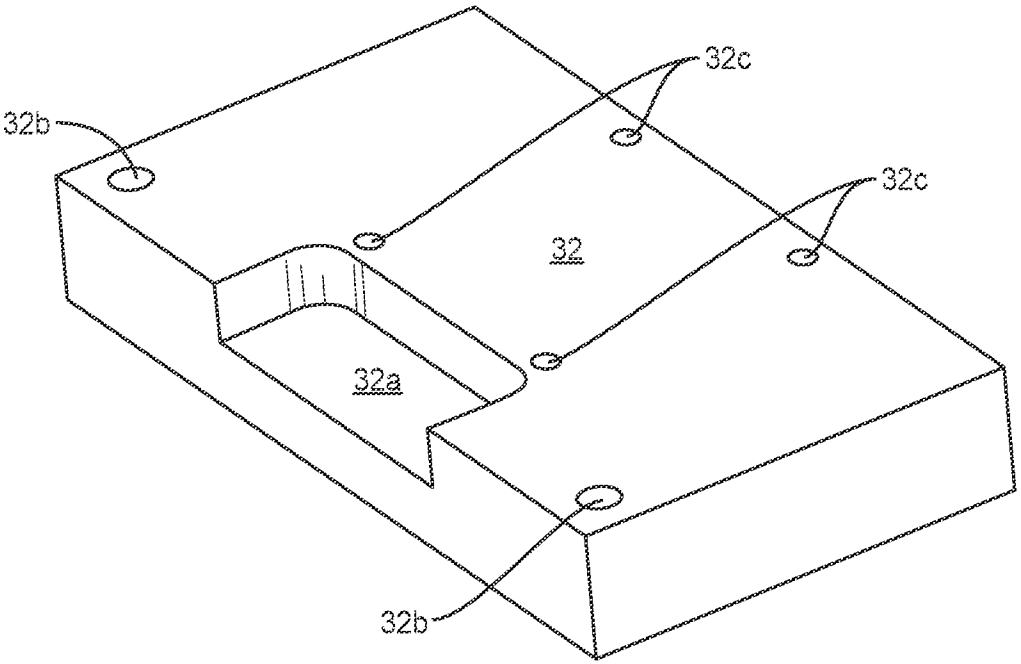

FIG. 4D is a perspective view of the riser block 32 according to one embodiment of the present disclosure. As seen in FIG. 4D, the riser block 32 comprises a pair of through holes 32*b* that are sized and shaped to receive a pair of corresponding mechanical fasteners m. As previously stated, these fasteners securely affix the riser block 32 to the top surface of the box 20. So attached, the riser block 32 desirably provides the necessary clearance above the top surface of the box 20 for the adjustor block 42 to move horizontally relative to the grinding wheel 24. Additionally, however, riser block 32 also includes a recessed receiving area 32*a*. In this embodiment, the recessed receiving area 32*a* is sized and shaped to receive at least a portion of the adjustor block 42 when it is moved towards the riser block 32.

The riser block 32 also comprises a second plurality of through holes 32*c*. However, the second plurality of through holes 32*c* are sized and shaped to receive another set of mechanical fasteners that securely attach the adjustable guide block 34 to the riser block 32.

The present disclosure may, of course, be carried out in other ways than those specifically set forth herein without departing from essential characteristics of the disclosure. For example, the previous embodiments illustrate the guide bearing 50 above the grinding wheel. In other embodiments, however, the guide bearing 50 may be disposed below the grinding wheel 24. In these embodiments, the box 20 may be modified to incorporate at least a part of the adjustor assembly 30. Therefore, the present embodiments are to be considered in all respects as illustrative and not restrictive, and all changes coming within the meaning and equivalency range of the appended claims are intended to be embraced therein.

What is claimed is:

1. A sharpening machine for skate blades, the sharpening machine comprising:

a grinder housing comprising a grinding wheel configured to sharpen a skate blade releasably clamped in spaced-relation to a template that defines a predetermined profile for the skate blade; and an adjustable guide assembly attached to the grinder housing and comprising:

a vertically adjustable guide bearing configured to engage and ride along the template while the skate blade is being sharpened;

an adjustable guide block configured to move the guide bearing horizontally relative to the grinding wheel; and a riser block configured to operatively connect the adjustable guide block to a surface of the grinder housing.

2. The sharpening machine of claim 1 further comprising a clamp assembly configured to releasably clamp the skate blade and the template in the spaced relation.

3. The sharpening machine of claim 1 further comprising one or more coupling members disposed between the skate blade and the template and configured to:

releasably attach the skate blade to the template; and maintain the skate blade and the template in the spaced-relation.

4. The sharpening machine of claim 1 further comprising:

an adjustor block operatively connected to the adjustable guide block, and configured to move horizontally with the guide bearing relative to the grinding wheel; and a cutout formed in the riser block, and configured to receive at least a portion of the adjustor block when the adjustor block moves horizontally towards the grinder housing.

5. The sharpening machine of claim 1 further comprising:

a vertical adjustment control extending through the adjustor block, and configured to control the vertical position of the guide bearing relative to the grinding wheel; and a horizontal adjustment control extending through the adjustable guide block, and configured to control the horizontal position of the guide bearing relative to the guide wheel.

6. The sharpening machine of claim 5 wherein the vertical adjustment control comprises a threaded shaft configured to threadingly engage the adjustor block.

7. The sharpening machine of claim 5 wherein the adjustor block comprises one or more locking members configured to lock and unlock the vertical adjustment control, wherein vertical movement of the guide bearing is prevented when the vertical adjustment control is locked, and is permitted when the vertical adjustment control is unlocked.

8. The sharpening machine of claim 1 wherein the guide bearing comprises:

a recess configured to contact a first surface of the template; and a stop formed at one end of the recess, and configured to:

contact a second surface of the template that is perpendicular to the first surface of the template; and inhibit the template from riding up the guide bearing while the skate blade is being sharpened.

9. The sharpening machine of claim 8 wherein the recess is configured to follow the predetermined profile of the template to transfer the predetermined profile to the skate blade while the skate blade is being sharpened.

10. The sharpening machine of claim 1 wherein the adjustable guide block comprises:

first and second terminal end blocks disposed on opposing sides of the adjustable guide block; and one or more adjustment rods extending through the adjustable guide block and connected at terminal ends to the first and second terminal end blocks.

11. The sharpening machine of claim 10 wherein the first terminal end block operatively connects the adjustable guide block to the guide bearing.

12. The sharpening machine of claim 11 wherein the adjustable guide block further comprises a horizontal adjustment control extending through the adjustable guide block and configured to control a horizontal position of the guide bearing relative to the guide wheel.

13. A sharpening system for ice skate blades, the system comprising:

a clamp assembly configured to releasably clamp a skate blade to be profiled and sharpened in spaced-relation to a template, wherein the template defines a predetermined profile to be transferred to the skate blade;

an adjustable guide bearing configured to engage and ride along the template while the skate blade is being sharpened; and a grinding wheel configured to simultaneously sharpen and profile the skate blade in accordance with the predetermined profile of the template; and one or more coupling members configured to magnetically attach the skate blade to the template.

14. The sharpening system of claim 13 further comprising:

a housing configured to house the grinding wheel; and an adjustable guide assembly configured to adjust one or both of a horizontal and vertical position of the guide bearing relative to the grinding wheel.

15. The sharpening system of claim 14 wherein the adjustable guide assembly further comprises:

an adjustor block operatively connected to the guide bearing;

a vertical adjustment control operatively connected to the adjustor block and configured to vary a vertical position of the guide bearing relative to the grinding wheel responsive to user input;

a horizontal adjustment control operatively connected to the adjustor block and configured to vary a horizontal position of the guide bearing relative to the grinding wheel responsive to user input; and a riser block operatively connecting the adjustable guide assembly to a surface of the housing and comprising a cutout configured to receive at least a portion of the adjustor block when the adjustor block is moved horizontally towards the housing.

16. A sharpening machine for skate blades, the sharpening machine comprising:

a grinder housing comprising a grinding wheel configured to sharpen a skate blade releasably clamped in spaced-relation to a template that defines a predetermined profile for the skate blade; and an adjustable guide assembly attached to the grinder housing and comprising:

a vertically adjustable guide bearing configured to engage and ride along the template while the skate blade is being sharpened;

an adjustable guide block configured to move the guide bearing horizontally relative to the grinding wheel, the adjustable guide block comprising:

first and second terminal end blocks disposed on opposing sides of the adjustable guide block; and one or more adjustment rods extending through the adjustable guide block and connected at terminal ends to the first and second terminal end blocks.

* * * * *